US009404647B2

(12) United States Patent
Duckworth

(10) Patent No.: US 9,404,647 B2
(45) Date of Patent: Aug. 2, 2016

(54) CLASS 1 COMPLIANT LENS ASSEMBLY

(71) Applicant: Hubbell Incorporated, Shelton, CT (US)

(72) Inventor: Jason Edward Duckworth, Simpsonville, SC (US)

(73) Assignee: Hubbell Incorporated, Shelton, CT (US)

( * ) Notice: Subject to any disclaimer, the term of this patent is extended or adjusted under 35 U.S.C. 154(b) by 83 days.

(21) Appl. No.: 14/153,813

(22) Filed: Jan. 13, 2014

(65) Prior Publication Data

US 2014/0268763 A1 Sep. 18, 2014

Related U.S. Application Data

(60) Provisional application No. 61/794,456, filed on Mar. 15, 2013.

(51) Int. Cl.

| | |
|---|---|
| ***F21V 25/12*** | (2006.01) |
| *F21V 25/00* | (2006.01) |
| *F21V 31/00* | (2006.01) |
| *F21V 5/00* | (2015.01) |
| *F21V 5/04* | (2006.01) |
| *F21Y 101/02* | (2006.01) |
| *F21Y 105/00* | (2016.01) |

(52) U.S. Cl.

CPC ..... *F21V 25/12* (2013.01); *F21V 5/007* (2013.01); *F21V 5/04* (2013.01); *F21V 31/005* (2013.01); *F21Y 2101/02* (2013.01); *F21Y 2105/001* (2013.01)

(58) Field of Classification Search

CPC ..... G02B 1/04–1/043; G02B 7/02–7/16; G02B 3/0075; F21V 19/001–19/0055; F21V 25/12–25/125

See application file for complete search history.

(56) References Cited

U.S. PATENT DOCUMENTS

| | | | | |
|---|---|---|---|---|
| 7,094,459 | B2 | 8/2006 | Takahashi | |
| 7,566,147 | B2 | 7/2009 | Wilcox et al. | |
| 7,845,829 | B2 | 12/2010 | Shaner et al. | |
| 7,938,558 | B2 | 5/2011 | Wilcox et al. | |
| 8,093,609 | B2 | 1/2012 | Hand et al. | |
| 8,184,440 | B2 | 5/2012 | Sekowski et al. | |
| 8,378,374 | B2 | 2/2013 | Loh et al. | |
| 8,390,022 | B2 | 3/2013 | Hussell et al. | |
| 8,410,491 | B2 | 4/2013 | Loh et al. | |
| 8,461,603 | B2 * | 6/2013 | Wu | F21V 19/003 174/520 |
| 8,545,049 | B2 | 10/2013 | Davis et al. | |
| 8,556,490 | B1 | 10/2013 | Bohler | |
| 2006/0044806 | A1 | 3/2006 | Abramov et al. | |
| 2008/0061314 | A1 | 3/2008 | Liaw et al. | |
| 2008/0273327 | A1 * | 11/2008 | Wilcox | F21S 2/005 362/267 |

(Continued)

OTHER PUBLICATIONS

"PETRA PET Product Selection Guide", 2003, BASF Corporation.*

(Continued)

*Primary Examiner* — Elmito Breval
*Assistant Examiner* — Nathaniel Lee
(74) *Attorney, Agent, or Firm* — Michael Best & Friedrich, LLP

(57) ABSTRACT

An optical assembly including a mounting board and an LED coupled to the mounting board. An optic component, for example a lens, is coupled to the mounting board and encloses the LED. A shield member including 5 VA rated material is positioned to have a first surface in contact with the mounting board and a second surface in contact with the optic component.

20 Claims, 16 Drawing Sheets

(56) References Cited

U.S. PATENT DOCUMENTS

| | | | | |
|---|---|---|---|---|
| 2010/0002450 | A1* | 1/2010 | Pachler | H01L 33/58 362/311.02 |
| 2010/0085751 | A1 | 4/2010 | Shaner | |
| 2010/0177509 | A1 | 7/2010 | Pickard | |
| 2010/0271825 | A1 | 10/2010 | Black et al. | |
| 2011/0103051 | A1 | 5/2011 | Wilcox et al. | |
| 2011/0114979 | A1 | 5/2011 | Jang | |
| 2011/0304268 | A1 | 12/2011 | Bertram et al. | |
| 2012/0086886 | A1 | 4/2012 | Mouri | |
| 2013/0002134 | A1 | 1/2013 | Matsunaga et al. | |
| 2013/0021776 | A1 | 1/2013 | Veerasamy et al. | |
| 2013/0201654 | A1 | 8/2013 | Pickard | |
| 2013/0201679 | A1 | 8/2013 | Pickard et al. | |
| 2013/0208442 | A1 | 8/2013 | Reiherzer | |

OTHER PUBLICATIONS

Notification of Transmittal of the International Search Report and the Written Opinion of the International Searching Authority . . . , Mailed Jul. 10, 2014, 13 pages.

* cited by examiner

CLASS 1 COMPLIANT LENS ASSEMBLY

CLAIM TO PRIORITY

This application is based on provisional application Ser. No. 61/794,456, filed Mar. 15, 2013, the disclosure of which is incorporated herein by reference and to which priority is claimed.

FIELD OF THE INVENTION

The present invention relates generally to a lens assembly for light emitting diodes (LEDs). The lens assembly creates a Class 1 protection zone in accordance with the National Electric Code (NEC).

BACKGROUND

An LED is a light generating semiconductor element that can be connected to a source of electricity. LEDs can generate light at a variety of wavelengths and levels of brightness with greater life, better durability, and higher energy efficiency than traditional lighting solutions. LEDs are increasingly being used in diverse applications including interior and outdoor lighting. For example, wall and ceiling mounted lights, floodlights, garage and parking lights, roadway lights, and landscape lighting have all incorporated LEDs.

LED lighting devices typically utilize a plurality of LEDs mounted on a surface, such as a printed circuit board. The LEDs may be in LED packages that contain a semiconductor chip which generates light and is embedded on a submount. The submount may include a heat sink and is typically surrounded by an outer housing. A primary lens extends from the housing and further encloses the semiconductor chip. Anode and cathode leads, pads, or terminals, may extend out of the housing to conduct electricity to the semiconductor chip. The LEDs and the printed circuit board are typically covered by a housing, which may provide protection against external elements. Various internal reflectors or lenses may be provided inside the housing for amplifying and directing light as needed.

For a number of applications, the voltage used to power the LEDs renders the device a non-Class 2 component as defined by NEC Article 725 which is incorporated herein by reference. Class 2 devices have a limit of 60 V peak voltage in the U.S. and 42.2 V peak voltage in Canada. If the voltage exceeds these levels, the devices are designated by the Underwriters Laboratories (UL) as a fire risk and must be contained in Class 1 compliant appropriate housing using only suitable materials.

Typical enclosures have utilized glass and/or metal housings that are secured to the circuit board and spaced apart from the LEDs. Such enclosures, however, can be, expensive, heavy, prone to break, and present additional risks to users. These enclosures may also negatively affect the amount of light that can be transmitted from the LED to the environment. To compensate for this deficiency, more LEDs must be used or the brightness of the LEDs must be increased, further increasing costs and reducing the energy efficiency of each lighting unit.

SUMMARY

In accordance with an embodiment, an optical assembly includes: a mounting board; an LED coupled to the mounting board; an optic component coupled to the mounting board and enclosing the LED; and a shield member including 5 VA rated material having a first surface in contact with said mounting board and a second surface in contact with said optic component.

In accordance with a further embodiment, an optical assembly includes: a mounting board; an LED coupled to the mounting board; an optic component coupled to the mounting board, enclosing the LED, and having a central lens portion and an edge; and a shield member having an opening for receiving the LED, a first surface in contact with the mounting board, and a second surface in contact with the optic component, wherein the material provides a Class 1 compliant enclosure between the mounting board and the optic component.

In accordance with another embodiment, an LED assembly includes: a mounting board; an LED package coupled to said mounting board; an optic component enclosing said LED package having a central lens portion, an edge, and a pin at least partially inserted into said mounting board; and a shield member including 5 VA material having a central opening for receiving said LED, an outer opening for receiving said pin, a first surface in contact with said mounting board, and a second surface in contact with said optic component.

Other embodiments, including apparatus, systems, methods, and the like which constitute part of the invention, will become more apparent upon reading the following detailed description of the exemplary embodiments and viewing the drawings. It is to be understood that both the foregoing general description and the following detailed description are exemplary and explanatory only and therefore not restrictive.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF EXEMPLARY EMBODIMENT(S) AND EXEMPLARY METHOD(S)

Figure 1:
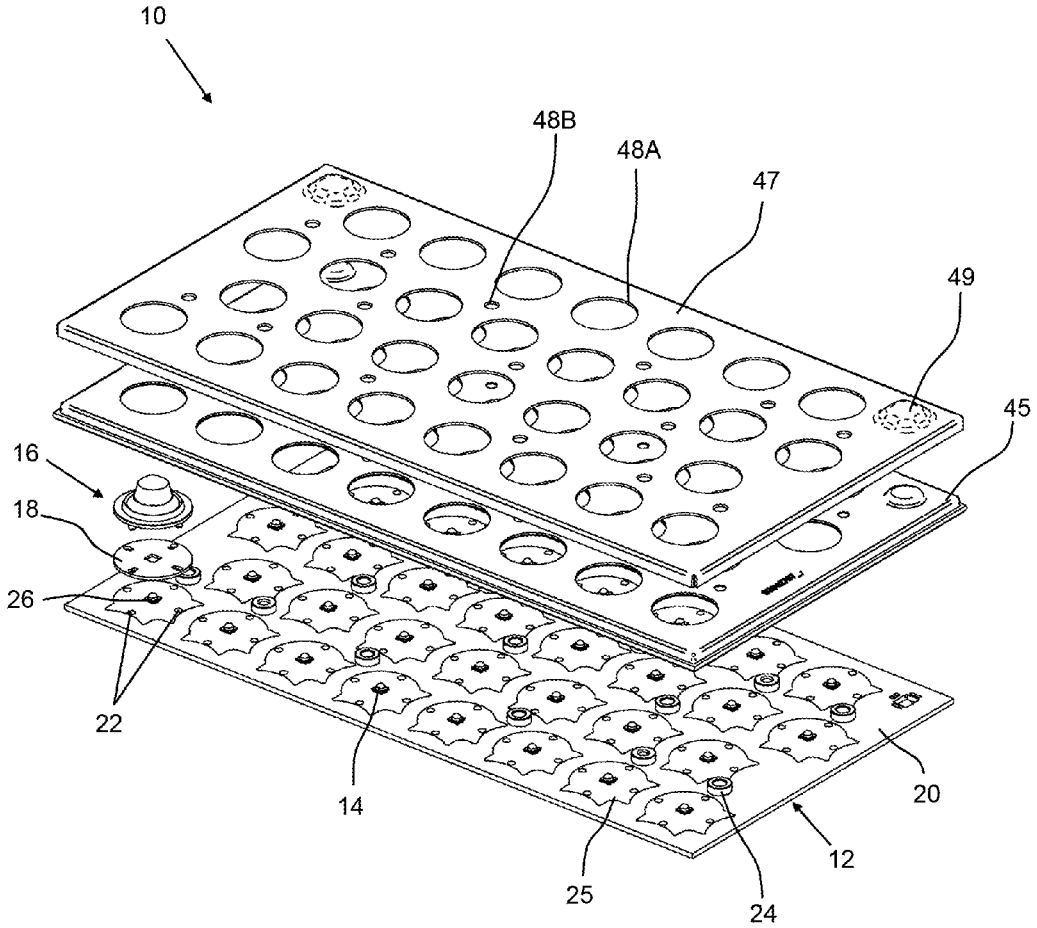
FIG. 1 is a perspective, exploded view of an exemplary LED module.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

Figure 2:
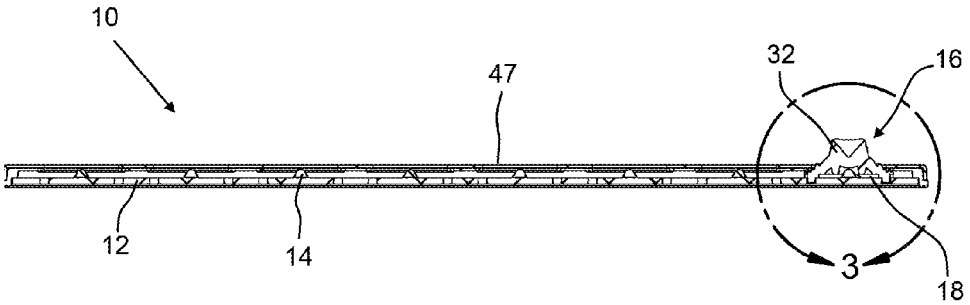
FIG. 2 is a front, sectional view of the LED module of FIG. 1 taken through the midpoint of the secondary lens.

As best shown in FIGS. 1 and 2, an LED module 10 includes a mounting board 12, at least one LED 14 (and potentially about 30 in various configurations as appropriate), an optic component 16, and a shield member 18. The LEDs 14 are suitably coupled to the mounting board 12. The shield member 18 is placed over the mounting board 12 and the LEDs 14 extend through the shield member 18. The optic component 16 is placed on the shield member 18 and covers a respective LED 14. An assembled LED module 10 may be used alone or in combination with other modules to create an LED lighting unit.

The mounting board 12 may be a variety of different substrates depending on the desired application. In various exemplary embodiments, the mounting board 12 is a printed circuit board that supports various electrical and mechanical components of the LED module 10. The printed circuit board also includes pathways to power electrical components. Different components may include the LEDs 12 and other drive and control electronics (not shown) associated with operating the LED module 10. The number and type of LEDs 14 and the number and type of additional components will vary depending on the application and device as would be understood by one of ordinary skill in the art.

The mounting board 12 has a top surface 20 and a plurality of primary openings 22 formed in the top surface. The openings 22 enable attachment of additional components such as the optic component 16. A plurality of spacers 24 may also extend from the mounting board 12 to provide a defined spacing between the top surface 20 and additional casing layers as discussed in greater detail below. Although various sizes and shapes of spacers 24 may be used, cylindrical spacers 24 are efficient for spacing and placement considerations while providing sufficient support. The spacers 24 may be placed in any number or configurations as required.

A series of solder masks 25 may be placed over the top surface of the mounting board 12. The solder masks 25 may surround the LEDs 14 and the primary openings 22. The solder masks 25 may have a variety of shapes as convenient for manufacturing. The solder masks 25 may be placed at locations to facilitate attachment of the optic component 16.

The LEDs 14 may be LED packages that contain a semiconductor chip (not shown) which generates light. The semiconductor chip is embedded on a submount (not shown). The submount may include a heat sink and is typically surrounded by an LED housing 26. A primary lens 28 extends from the housing 26 and further encloses the semiconductor chip. Anode and cathode leads, pads, or terminals (not shown) may extend from the housing 26 to conduct electricity to the semiconductor chip. LED packages may be composed of different materials and components as would be understood by one of ordinary skill in the art. The LED packages may be permanently connected to the mounting board 12, for example through soldering or an adhesive. Various LED packages may be rated as Class 1 compliant and therefore may be used with LED devices having higher voltages.

Figure 4:
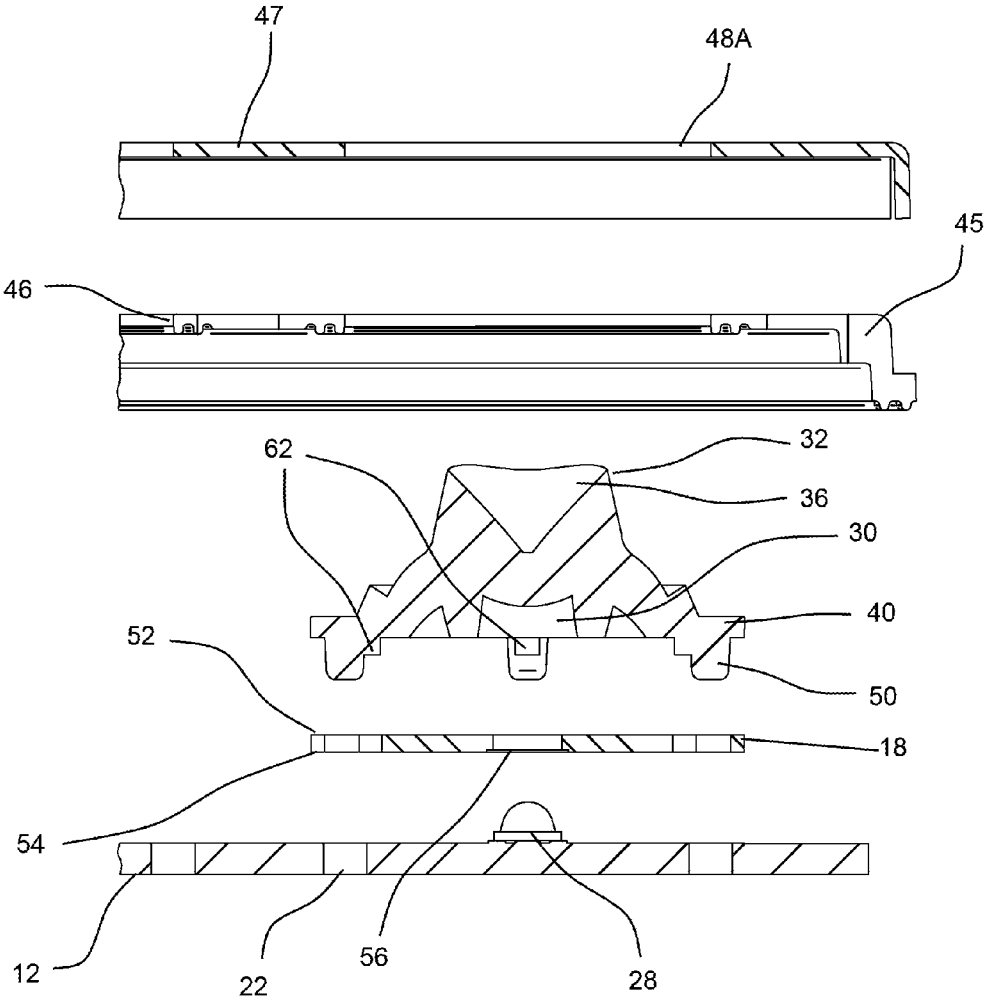
FIG. 4 is an exploded view of FIG. 3.
Figure 5:
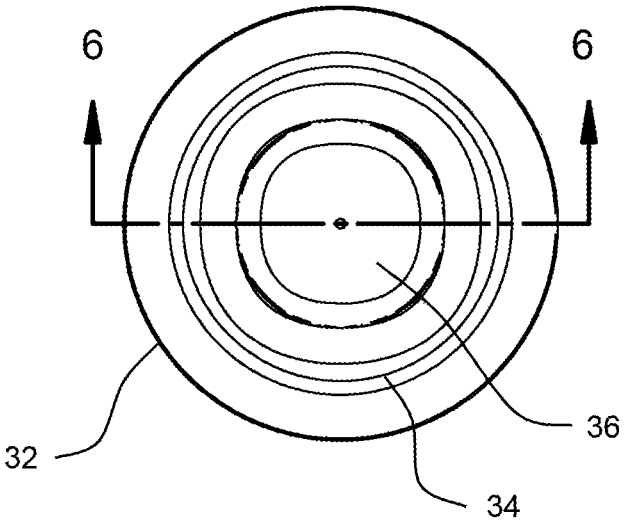
FIG. 5 is a top, plan view of the exemplary secondary lens and shield member shown in FIG. 1.
Figure 6:
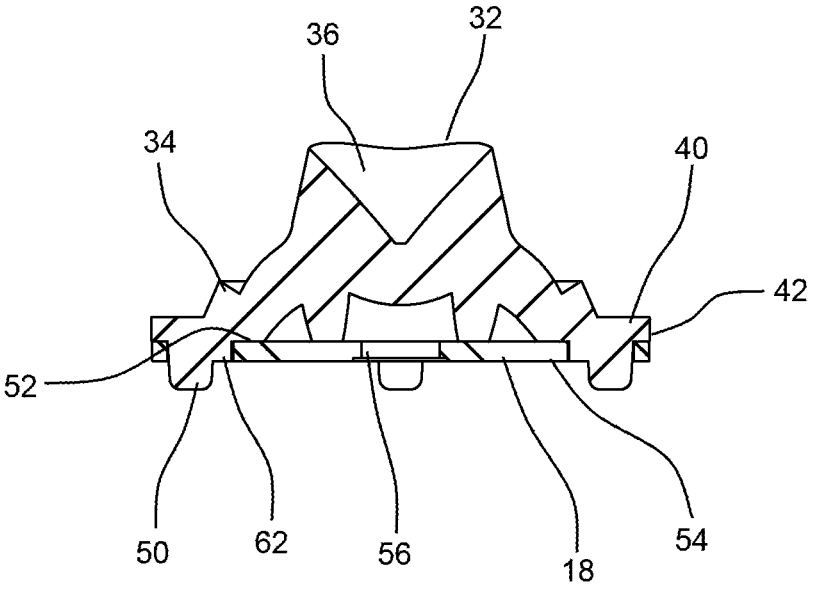
FIG. 6 is a front, sectional view of the secondary lens of FIG. 5.
Figure 7:
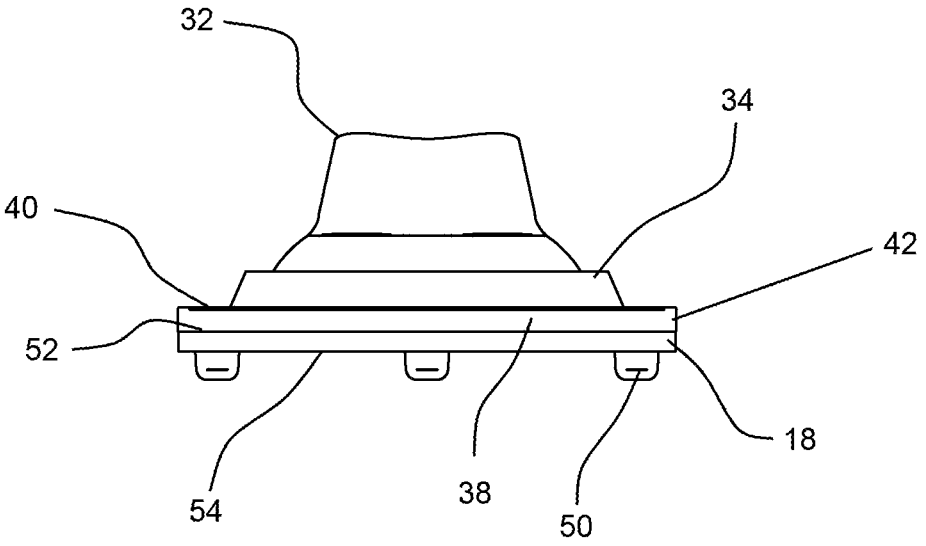
FIG. 7 is a front, elevational view of the secondary lens and shield member of FIG. 5.

The optic component 16 is supported and coupled to the mounting board 12 and positioned over the LED 14. A cavity 30 formed between the LED 14 and the optic component 16 receives various sized LEDs 14 or LED packages. The optic component 16 includes a secondary lens 32. The secondary lens 32 may have different shapes and sizes to direct or diffuse light from the LED 14 at different directions, angles, and intensities. The optic component 16 may contain other elements apart from the secondary lens 32. As best shown in FIGS. 4-6, the secondary lens 32 has an outer rim 34 and an inner cone or conical surface 36 interconnected by a frustoconical surface 35. The inner cone 36 is designed to reduce the diffraction of the light emitted from the LED, concentrating and directing it to a specific region. The outer rim 34 extends to a substantially circular base 38 having flange 40 bounded by an outer edge 42. Though a conical secondary lens 32 and circular base 38 are shown, the secondary lens 32 and base 38 may have any combination of curvilinear or rectilinear configurations.

Figure 3:
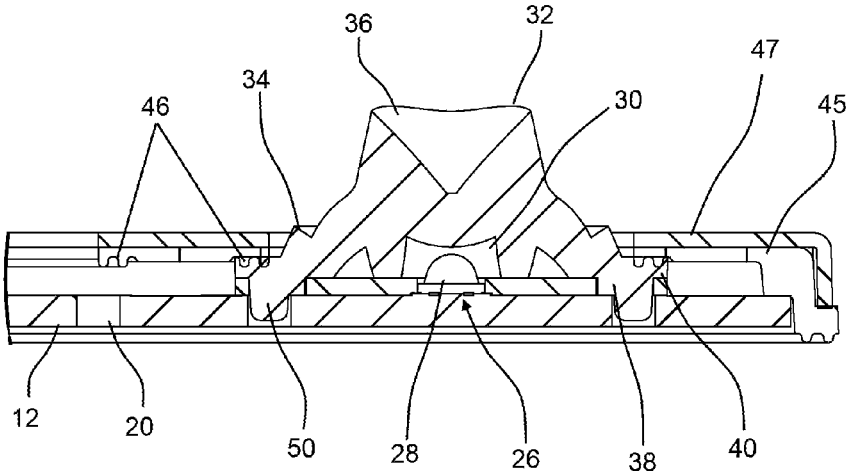
FIG. 3 is an enlarged, fragmentary view of the LED module of FIG. 1.

As best shown in FIGS. 3 and 4, the flange 40 may support a module housing 44. The module housing 44 may include a resilient layer 45 and an enclosure 47. The resilient layer 45 is made from a resilient material such as silicone and act as a gasket. The resilient layer 45 may include ribs 46 to assist in sealing the resilient layer 45 to the flange 40. The ribs 46 may surround the secondary lens 32.

The enclosure 47 may be placed over the resilient layer 45. The enclosure 47 may be made from any desired material, such as a metallic, ceramic, or polymer. The enclosure 47 compresses the resilient layer 44 to seal around the secondary lens 32 and may act to seal the resilient layer 44 to and/or around the mounting board 12. The module housing 44 may entirely enclose the mounting board 12 and have an opening through which the optic component 16, or only the secondary lens 32, extends. The module housing 44 may be placed into a lighting unit (not shown) alone or with other LED modules depending on the application. The spacers 24 may provide mechanical stops for the module housing 44, preventing contact with and damage of the mounting board 12. The enclosure 47 may include a set of primary openings 48A and a set of secondary openings 48B. The secondary lens 32 passes through the primary openings 48A to the exterior of the enclosure 47. The secondary openings 48B may receive fasteners (not shown) for attaching the enclosure 47 to the mounting board 12. The secondary openings 48B may be spaced to align with the spacers 24. The spacers 24 may additionally include interior threads to receive the fasteners. Similar openings may be placed in the resilient layer 45.

In various exemplary embodiments the optic component 16 includes pins 50 that may be inserted into the openings 22 in the mounting board 12. The pins 50 may extend from the base 38, or from any part of the optic component 16. The exemplary embodiments shown in the Figures utilize four pins 50, although any number of pins 50 may be used. At least two pins 50, may be utilized to facilitate attachment to the mounting board 20 without rotation. The optic component 16 also may be secured to the mounting board 12 with an adhesive in addition to, or in place of, the pins 50.

The optic component 16 may be composed of different materials or it may be unitarily formed or molded of a single material. The secondary lens 32 may include different materials, such as glass or a polymer. In various exemplary embodiments, the secondary lens 32 is made from an acrylic, for example poly-methyl methacrylate (PMMA). PMMA is an example of an ideal material for secondary lenses 32, based partially on cost, moldability, durability, impact resistance, index of refraction, and light transmissivity. For example, PMMA can have a light transmission rate of up to 92%, whereas typical glass has a transmission rate of about 90% or lower. PMMA is also beneficial for outdoor use due to its stability and resistance to discoloration caused by UV radiation. PMMA lenses, however, are not typically suitable for Class 1 compliant devices due to the fact that PMMA does not have suitable anti-flammability and melt characteristics. In other alternative embodiments, the secondary lens 32 may be made from synthetic compounds, for example silicone. Silicone is another example of an ideal material because it has high transparency, good photo-thermal stability, and can be formed to cover a wide range of refractive indices. Silicone is also easy to mold into different shapes and designs and has good impact strength.

In order to use acrylics such as PMMA, synthetic compounds such as silicone, or other noncompliant materials as secondary lenses 32, a shield member 18 may be placed between the mounting board 12 and the optic component 16. The shield member 18 may be removably placed in contact with the base 38, for example during assembly of the LED module 10, or it may be permanently affixed to the base 38, for example with an adhesive. The shield member 18 creates a Class 1 compliant zone between the mounting board 12 and the optic component 16. To create the Class 1 compliant zone, the shield member 18 may be made from a 5VA rated material as defined by the UL 94 flame rating standard. Examples of 5 VA rated material include various metallic materials of a certain thickness and suitable polymeric materials that meet the UL 94 5 VA standard, such as certain polycarbonate materials.

The shield member 18 has an upper surface 52 and a lower surface 54. The upper surface 52 is proximate the optic component 16, while the lower surface is proximate the mounting board 12. In various exemplary embodiments, the upper surface 52 is in direct, surface-to-surface contact with at least a portion of the optic component 16 and the lower surface 54 is in direct, surface-to-surface contact with at least a portion of the mounting board 12.

Figure 8:
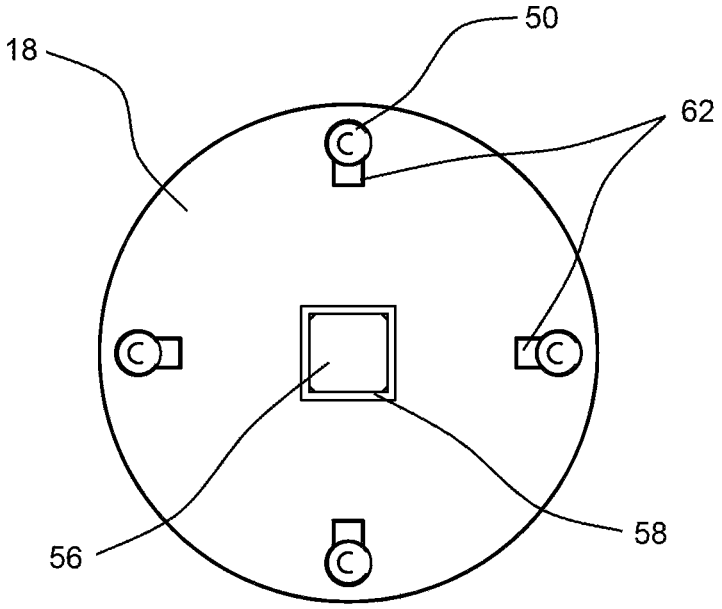
FIG. 8 is a bottom, plan view of the exemplary secondary lens and shield member of FIG. 5.
Figure 9:
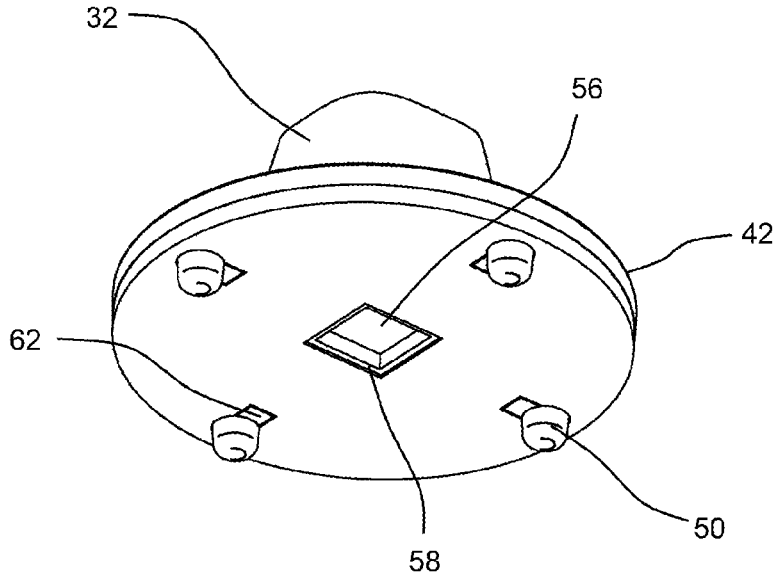
FIG. 9 is a perspective, bottom view of the exemplary secondary lens and shield member of FIG. 5.
Figure 10:
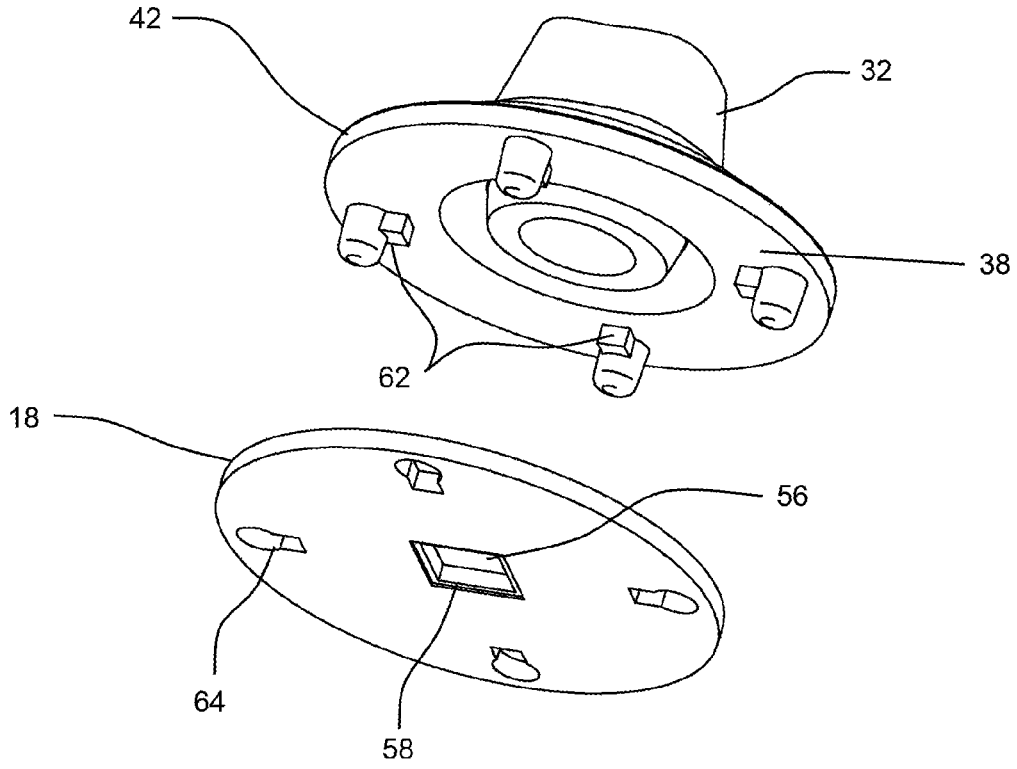
FIG. 10 is a perspective, exploded view of the exemplary secondary lens and shield member of FIG. 5.
Figure 11:
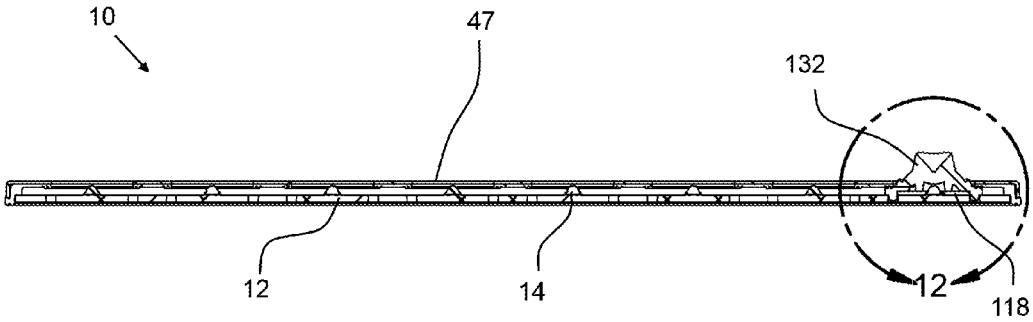
FIG. 11 is a front, sectional view of another exemplary LED module.
Figure 12:
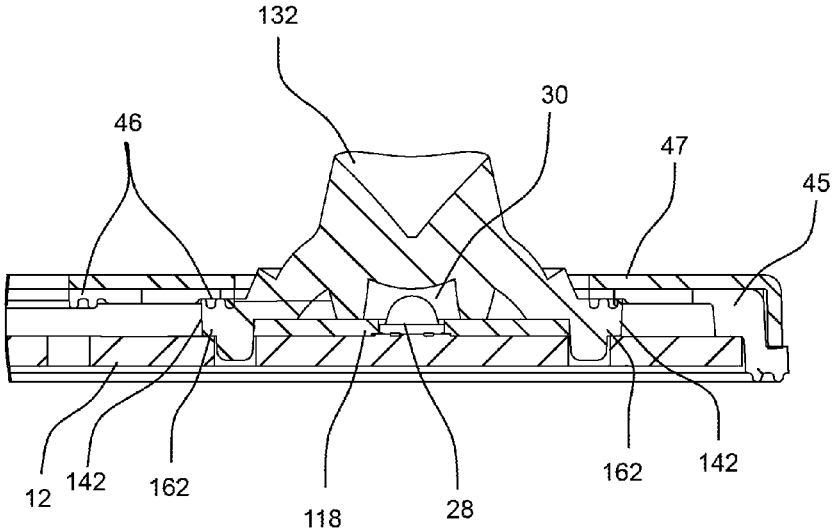
FIG. 12 is an enlarged, fragmentary view of FIG. 11.

A central aperture 56 is formed in the shield member 18 for receiving the LED 14 or an LED package. The central aperture 56 may be sized to receive the LED 14 so that the edge of the shield member 18 bounding the central aperture 56 is in contact with a portion of the LED 14. For example, in an LED module 10 utilizing LED packages, the edge bounding the central aperture 56 contacts the LED housing 26. As best shown in FIGS. 8-10 a lip 58 may extend from the shield member 18 into the central aperture 56 for contacting the LED 14. The lip 58 may have a reduced thickness compared to the area surrounding the central aperture 56 to increase flexibility and create a seal surrounding the LED 14. The lip 58 may have a constant thickness or it may vary in thickness from a region proximate the upper surface to a region proximate the lower surface. The shield member 18 may also include apertures (for example the apertures 64, 164, and 272 discussed in greater detail below) for receiving pins 50 from the optic component 16. The pins 50 extend through the outer aperture and into the mounting board 12. The number of outer apertures may equal the number of pins 50. Typically the apertures will correspond to the pins 50 as discussed in greater detail below, although a universal aperture may be used that is capable of receiving a variety of different pin 50 shapes and designs.

The shield member 18 and secondary lens 32 have been discussed above in generalized terms. Various exemplary embodiments may include different configurations, shapes, sizes, and materials in utilize the shield members 18 and secondary lenses 32 discussed herein.

In various exemplary embodiments, the secondary lens 32 may include pins 50 having tabs 62. As best shown in FIGS. 3-10, the tabs 62 may have a rectangular configuration and extend inward towards the center of the secondary lens 32. The tabs 62 may have a variety of shapes and may extend at different angles. The shield member 18 may have corresponding keyhole apertures 64 for receiving the pins 50 and the tabs 62. The tabs 62 may act as spacers to offset the base 38 from the mounting board 12. In certain embodiments, the thickness of the mounting board 12 may be reduced in order to accommodate the shield member 18. The tabs 62 allow the secondary lens 32 to be positioned on the mounting board 12 at a constant height, regardless of whether a shield member 18 is used or not. In this way, the mounting board 12 and the secondary lenses 32 may be used for a variety of LED modules, including Class 2 compliant modules which do not need to utilize the shield members 18.

FIGS. 11-24 depict various exemplary combinations of shield members 118, 218 and secondary lenses 132, 232. While the structures of the shield members 118, 218 and secondary lenses 132, 232 differ, the general characteristics and materials may be the same as those discussed above.

Embodiment of FIGS. 11-18

In various exemplary embodiments, the secondary lens 132 may include pins 150 having tabs 162. A slot 261 may be provided in the lens 132 to facilitate removal of the shield member 118 from the secondary lens 132 by a user. As best shown in FIGS. 11-18, the tabs 162 may have a rectangular configuration and extend outward towards the outer edge 142 of the secondary lens 132. The tabs 162 may have a variety of shapes and may extend at different angles. The shield member 118 has corresponding slots 164 for receiving the pins 150 and the tabs 162. These slots 164 may be open and extend all the way to the outer edge of the shield member as shown or they may be closed. As discussed above, the tabs 162 may act as spacers to offset the base 138 from the mounting board 12.

Figure 13:
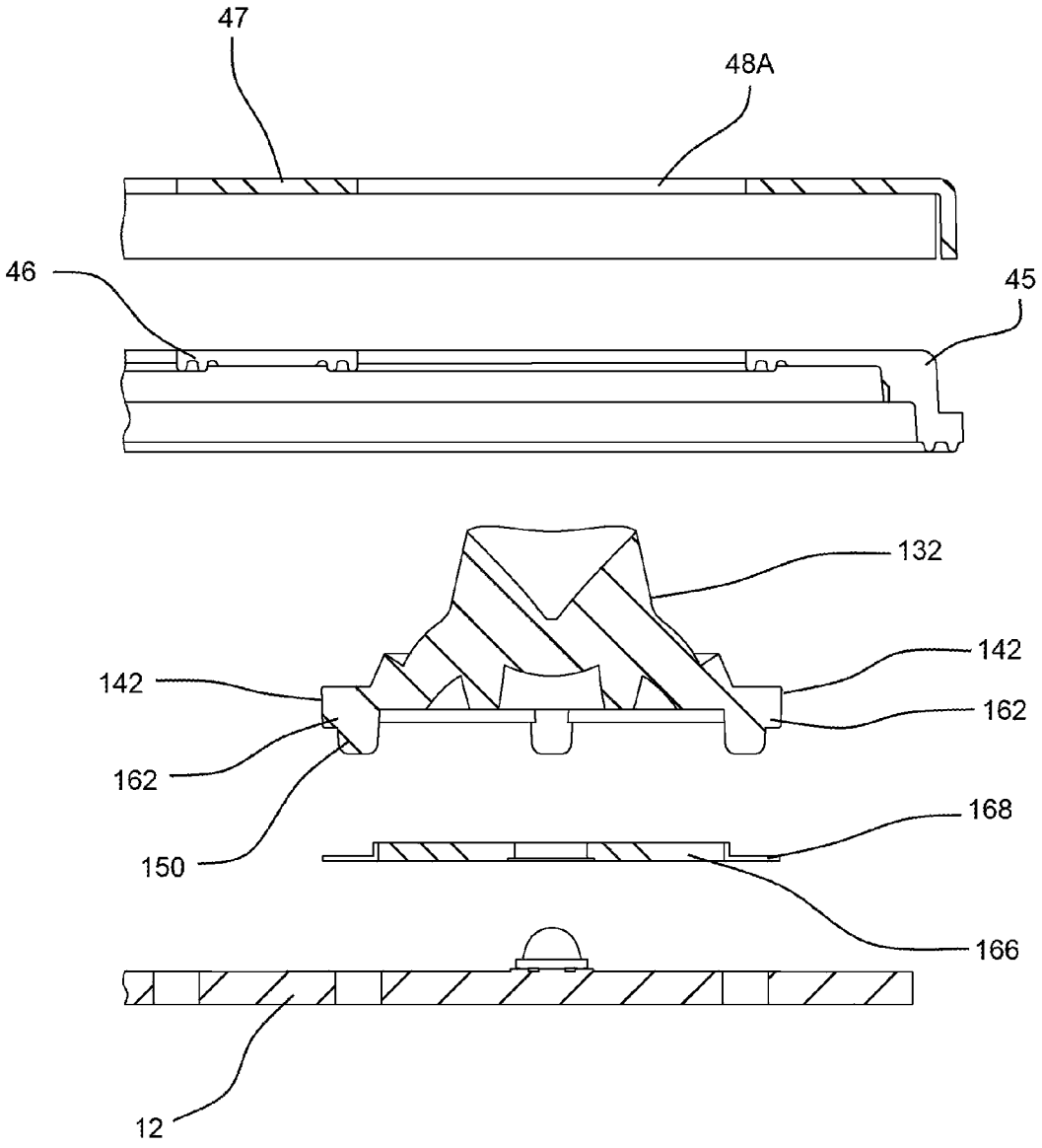
FIG. 13 is an exploded view of FIG. 12.
Figure 14:
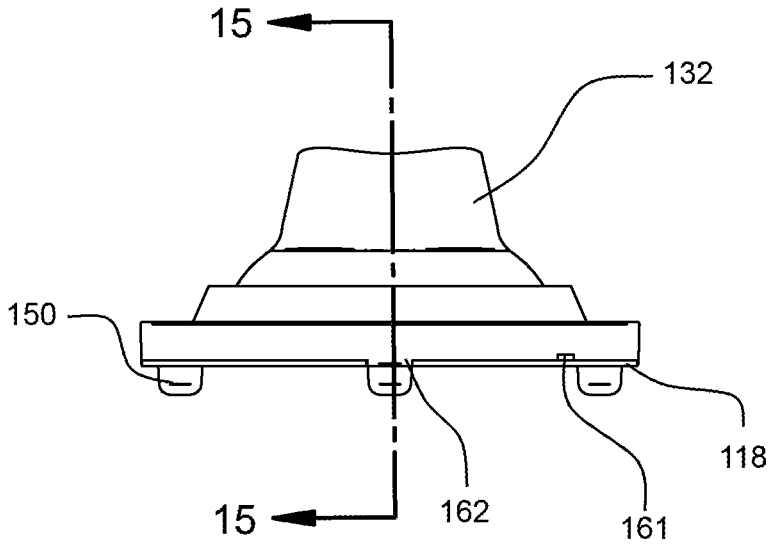
FIG. 14 is a side view of the exemplary secondary lens and shield member of the LED module shown in FIG. 11.
Figure 15:
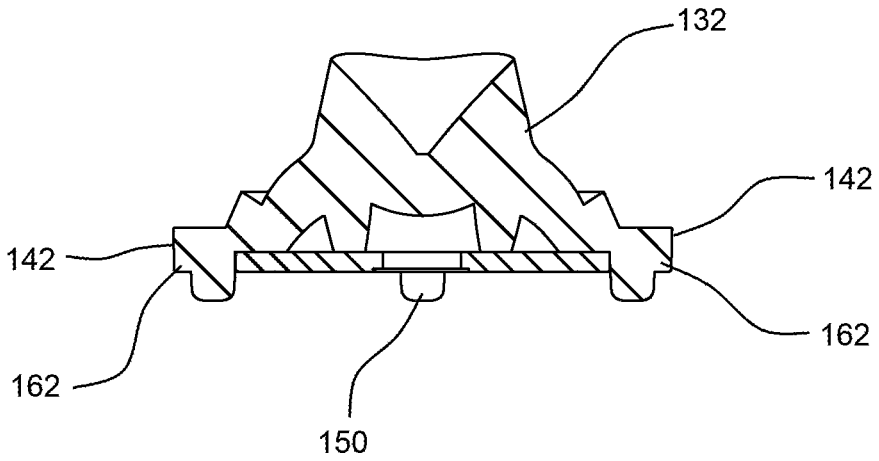
FIG. 15 is a front, sectional view of the secondary lens and shield member of FIG. 14.
Figure 16:
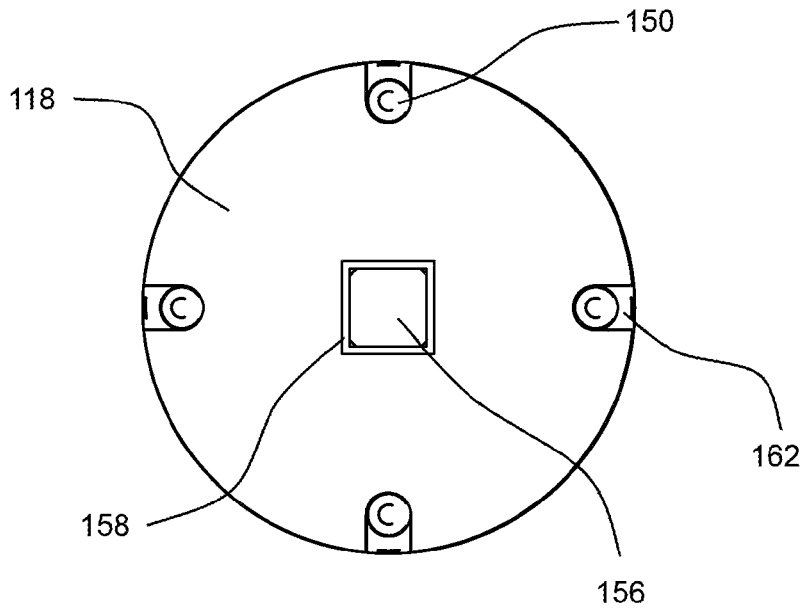
FIG. 16 is a bottom, plan view of the secondary lens and shield member of FIG. 14.
Figure 17:
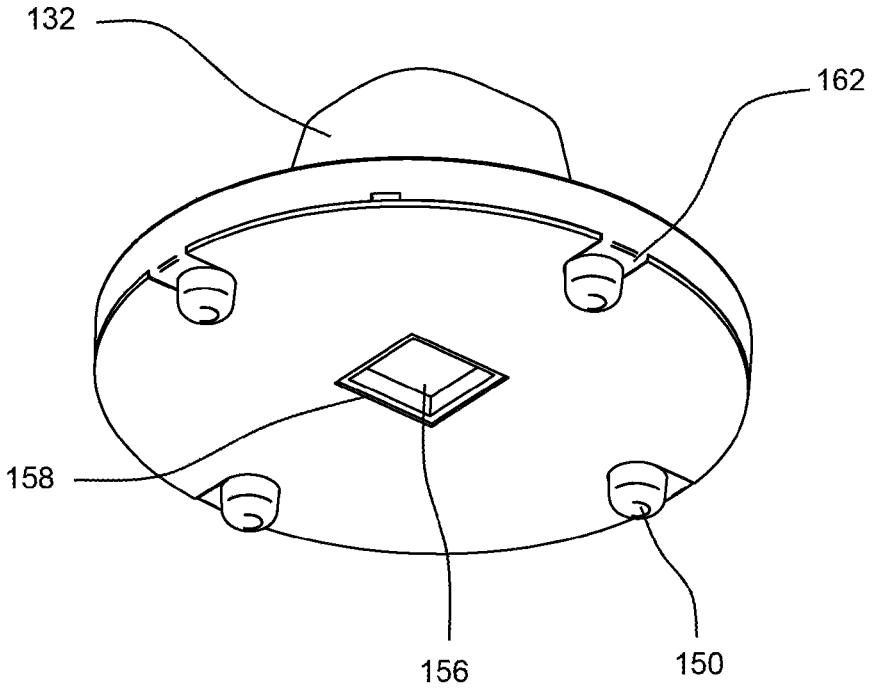
FIG. 17 is a perspective, bottom view of the exemplary secondary lens and shield member of FIG. 14.
Figure 18:
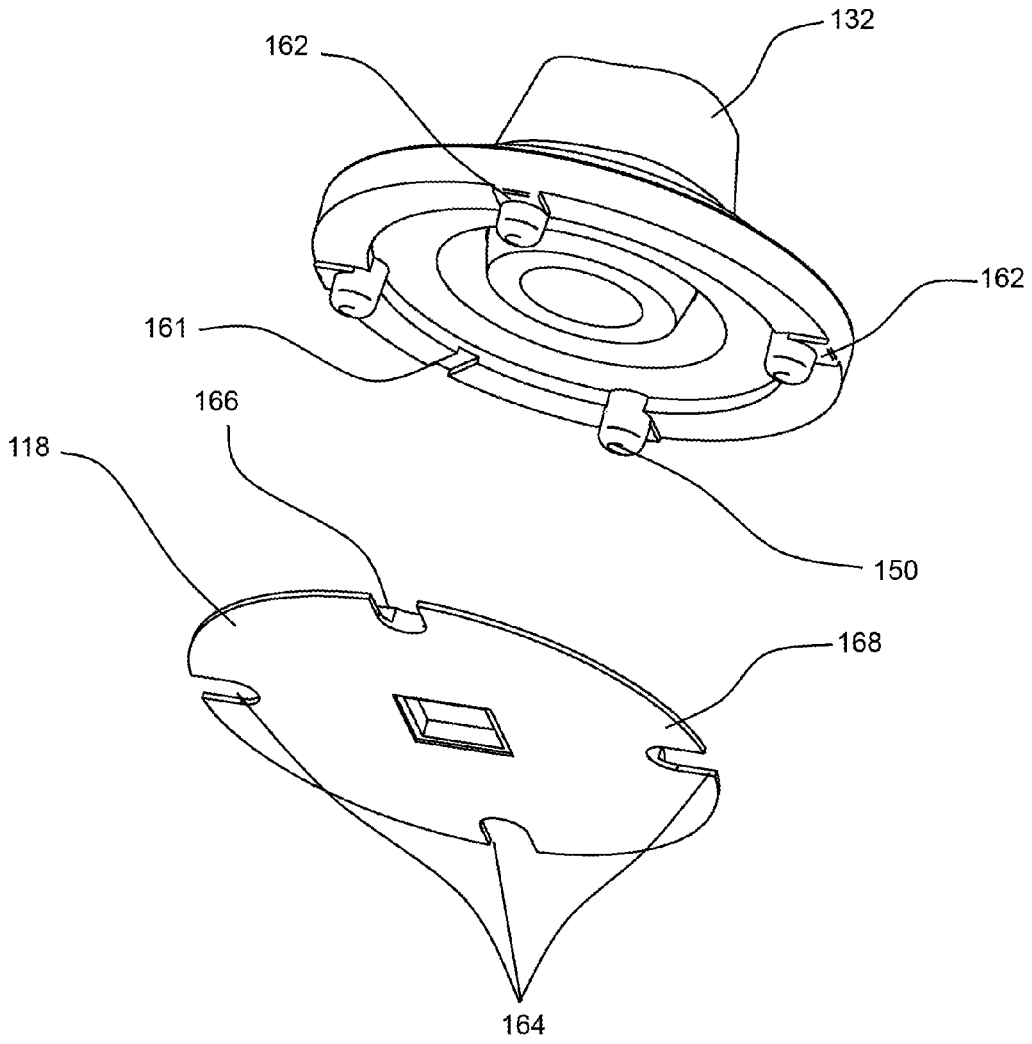
FIG. 18 is a perspective, exploded view of the exemplary secondary lens and shield member of FIG. 13.
Figure 19:
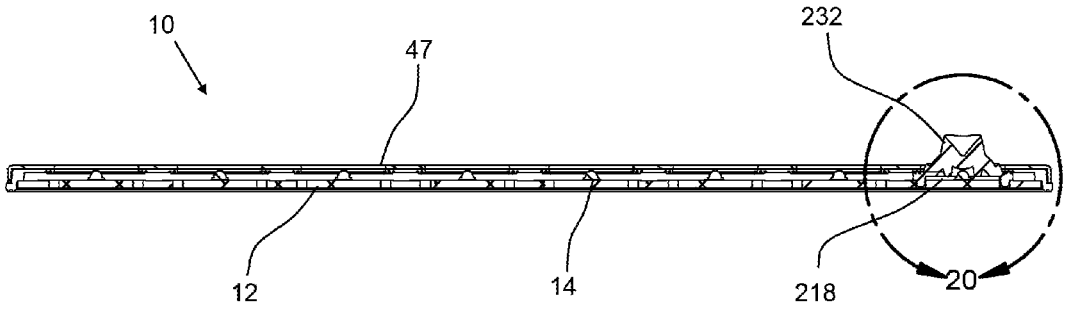
FIG. 19 is a front, sectional view of another exemplary LED module.
Figure 20:
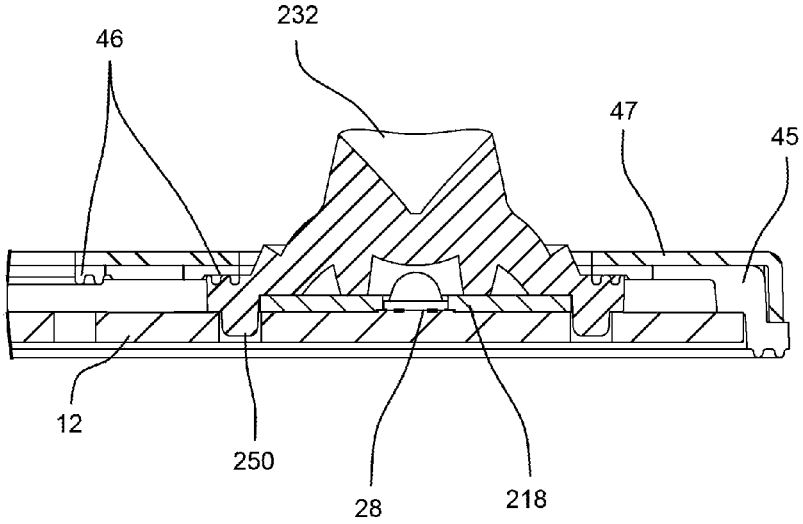
FIG. 20 is an enlarged, fragmentary view of FIG. 19.
Figure 21:
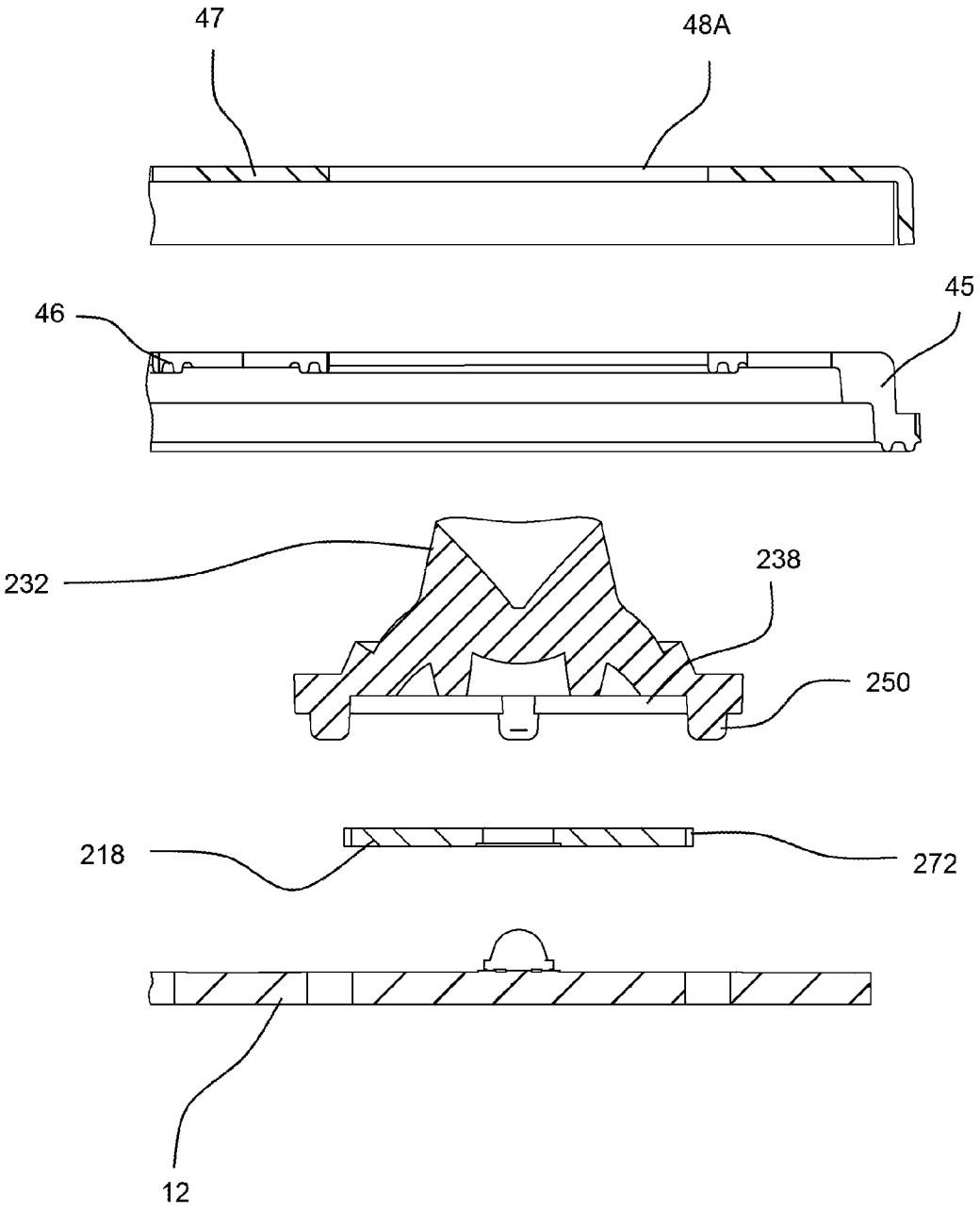
FIG. 21 is an exploded view of FIG. 20.
Figure 22:
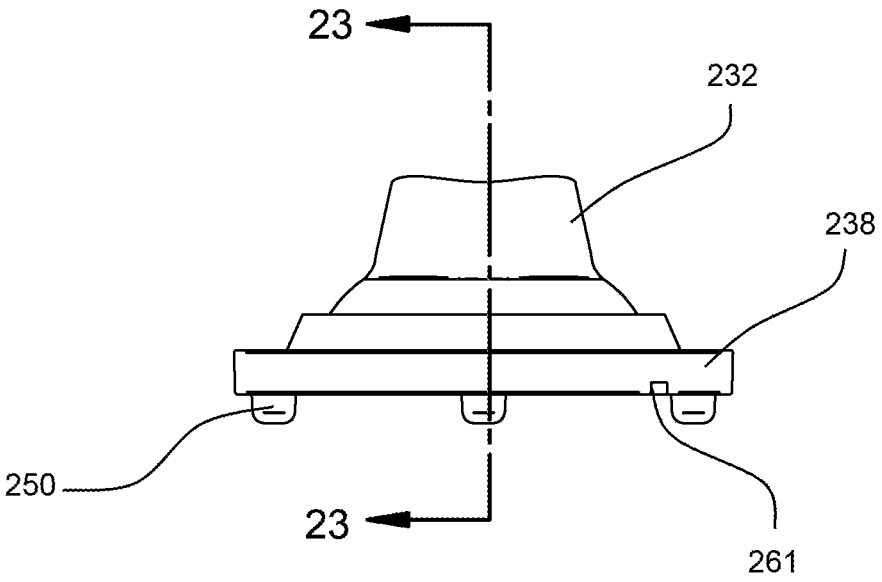
FIG. 22 is a side view of the exemplary secondary lens and shield member of the LED module shown in FIG. 19.
Figure 23:
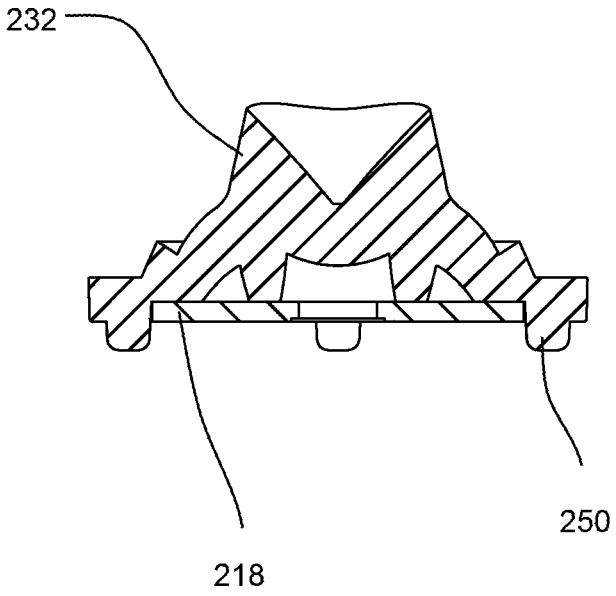
FIG. 23 is a front, sectional view of the secondary lens and shield member of FIG. 22.
Figure 24:
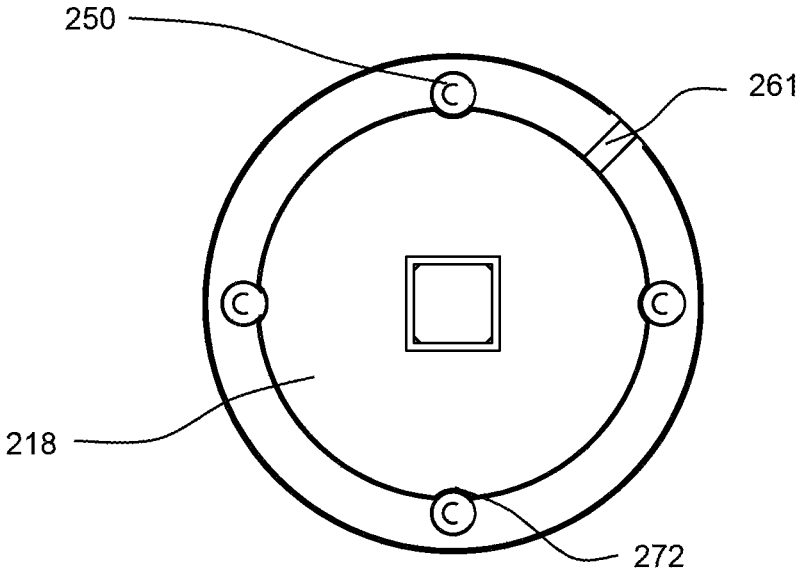
FIG. 24 is a bottom, plan view of the secondary lens and shield member of FIG. 22.
Figure 25:
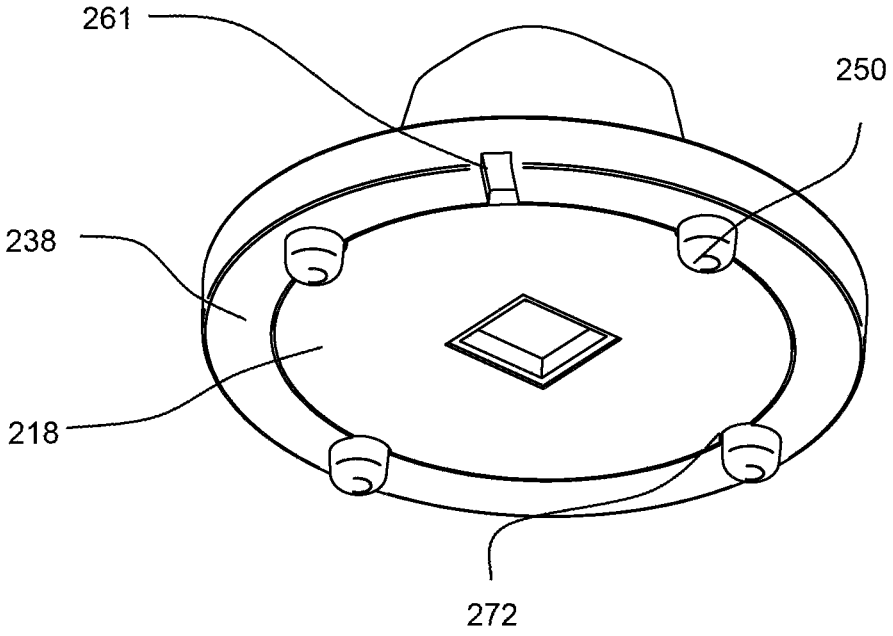
FIG. 25 is a perspective, bottom view of the exemplary secondary lens and shield member of FIG. 22.
Figure 26:
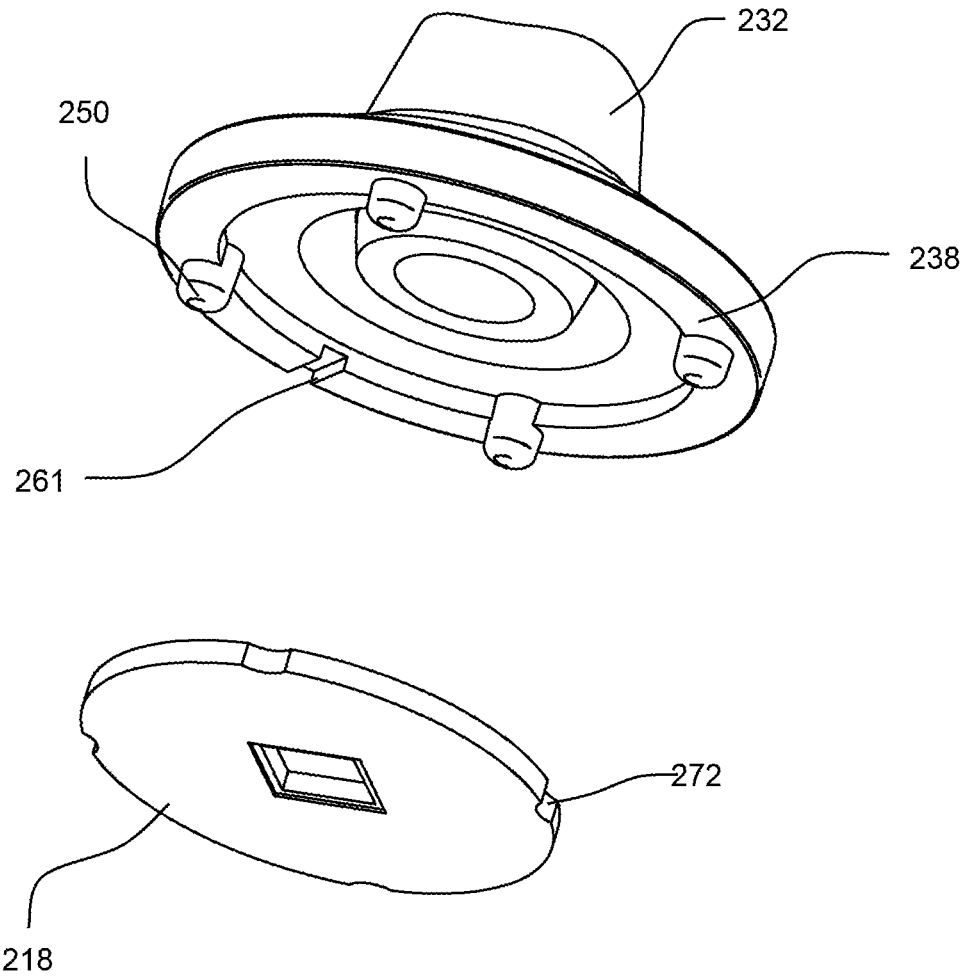
FIG. 26 is a perspective, exploded view of the exemplary secondary lens and shield member of FIG. 22.

As best shown in FIG. 13, the shield member 118 may have an inner region 166 and an outer region 168. The inner region 166 has a greater thickness than the outer region 168. The thicker inner region 166 provides additional shielding to the secondary lens 132. The slots 164 may be located in the outer region 168. The inner region 166 may extend from the aperture 156 or lip 158 to the inner edge of the slots 164. The outer region 168 may extend from the inner region 166 to the outer edge 142 of the secondary lens 132. The shield member 118 may also have a uniform thickness, apart from the lip 158.

Embodiment of FIGS. 19-26

In various exemplary embodiments, a secondary lens 232 may include a recess bound by the base 238 for receiving the shield member 218. The recess may be formed so that the shield member 218 fits flush with the bottom surface of the base 238. The pins 250 may extend beyond an inner wall of the base 238 towards the center of the secondary lens 232. The shield member 218 may have corresponding indentations 272 to accommodate the pins 250. In certain embodiments, the pins 250 do not extend beyond the inner wall of the base and the shield member 218 has an entirely constant outer edge. A slot 261 may be provided in the base 238 to facilitate removal of the shield member 218 from the secondary lens 232 by a user.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

Only those claims which use the words "means for" are to be interpreted under 35 U.S.C. 112, sixth paragraph.

What is claimed:

1. An optical assembly comprising:

a mounting board;

a plurality of LEDs coupled to said mounting board;

a plurality of optic components coupled to said mounting board and enclosing said LEDs; and a plurality of shield members with one shield member associated with each optic component and including 5 VA rated material having a first surface in contact with said mounting board and a second surface in contact with said optic component.

2. The optical assembly of claim 1, wherein said shield member provides a Class 1 compliant enclosure between said mounting board and said optic component.

3. The optical assembly of claim 2, wherein said optic component comprises PMMA.

4. The optical assembly of claim 3 , wherein said optic component comprises a lens.

5. The optical assembly of claim 2, wherein said optic component comprises silicone.

6. The optical assembly of claim 1, wherein said shield member comprises an opening for receiving said LED.

7. The optical assembly of claim 1, wherein said mounting board comprises a printed circuit board.

8. The optical assembly of claim 1, wherein said optic component comprises a recess receiving said shield member.

9. An optical assembly comprising:

a mounting board;

a plurality of LEDs coupled to said mounting board;

a plurality of optic components coupled to said mounting board, enclosing said LEDs, and having a central lens portion; and a shield member having an opening for receiving said LED, a first surface in contact with said mounting board, and a second surface in contact with said optic component, wherein said material provides a Class 1 compliant enclosure between said mounting board and said optic component.

10. The optical assembly of claim 9, wherein said shield member includes 5 VA rated material.

11. The optical assembly of claim 9, wherein said optic component comprises a pin and a tab extending from the pin and said shield member comprises an aperture for receiving said tab and said pin.

12. The optical assembly of claim 9, wherein said optic component comprises a recess for receiving said shield member.

13. The optical assembly of claim 9, wherein said LED comprises a Class 1 compliant LED package including a light-generating semiconductor element, a housing enclosing said light-generating semiconductor element, and a primary lens coupled to said housing.

14. The optical assembly of claim 9, wherein said optic component comprises a material selected from the group consisting of PMMA and silicone.

15. An LED assembly comprising:

a mounting board;

an LED package coupled to said mounting board;

an optic component enclosing said LED package having a central lens portion, an edge, and a pin at least partially inserted into said mounting board; and a shield member including 5 VA material having a central opening for receiving said LED, an outer opening for receiving said pin, a first surface in contact with said mounting board, and a second surface in contact with said optic component, wherein said shield member comprises an inner region having a first thickness and an outer region having a second thickness less than said first thickness, said pin has an inner portion, and said inner region extends to said inner portion of said pin and said outer region extends to said optic component edge.

16. The LED assembly of claim 15, wherein said shield member provides a Class 1 compliant enclosure between said mounting board and said optic component.

17. The LED assembly of claim 15, wherein said optic component edge is substantially circular and said shield member has a size and shape configured to said optic component.

18. The LED assembly of claim 15, wherein said optic component comprises a flange and said LED assembly further comprises a silicone gasket resting on said flange and a metal enclosure positioned over said silicone gasket.

19. The LED assembly of claim 15, wherein said optic component comprises a material selected from the group consisting of PMMA and silicone.

20. The LED assembly of claim 15, further comprising a second LED package coupled to said mounting board, a second optic component enclosing said second LED package, and a second shield member including 5 VA material having a central opening for receiving said second LED.

* * * * *